United States Patent [19]

Jones et al.

[11] 4,167,908

[45] Sep. 18, 1979

[54] SUSPENDIBLE PLANT RACK

[76] Inventors: William M. Jones; John H. Jones, both of 8505 Tioga Ave., Cleveland, Ohio 44105

[21] Appl. No.: 817,203

[22] Filed: Jul. 20, 1977

[51] Int. Cl.[2] ..... A47B 3/06; A47B 97/00

[52] U.S. Cl. ..... 108/111; 108/149; 108/153

[58] Field of Search ..... 108/111, 149, 153, 109, 108/60, 114; 211/113, 118, 153, 191

[56] References Cited

U.S. PATENT DOCUMENTS

| | | | |
|---|---|---|---|
| 806,893 | 12/1905 | Holder | 108/149 X |
| 1,282,104 | 10/1918 | Mork | 108/114 X |
| 1,815,858 | 7/1931 | Lifschultz | 211/191 X |
| 2,845,185 | 7/1958 | Winderweedle | 108/149 X |
| 3,722,431 | 3/1973 | Howard | 108/153 |
| 3,844,230 | 10/1974 | Hudson | 108/60 |
| 3,885,675 | 5/1975 | Hultenby et al. | 211/118 |
| 3,948,581 | 4/1976 | Helman | 108/111 |

*Primary Examiner*—Francis K. Zugel
*Attorney, Agent, or Firm*—Maky, Renner, Otto & Boisselle

[57] ABSTRACT

A suspendible plant rack facilitates the close packing of a plurality of plants in a given area, for example, in exposure to direct sunlight at a window area. The rack shelves are formed by plural separated slats and the vertical side supports are similarly formed, thus enhancing air circulation characteristics about the rack. In one embodiment the shelves are held balanced by mechanical tie-downs and in another embodiment a cooperative notch arrangement assures such balancing.

10 Claims, 4 Drawing Figures

SUSPENDIBLE PLANT RACK

BACKGROUND OF THE INVENTION

The present invention relates generally, as indicated, to plant racks and, more particularly, to a plant rack that is suspendible, for example, from the ceiling of a room.

In the past plants have been individually hung from separate hangers mounted in the ceiling of a room. Such hanging procedure is time consuming and usually does not enable a convenient change in the arrangement of plants. To hang multiple plants, a corresponding number of hangers are required, thus necessitating substantial labor and being somewhat destructive of the ceiling. There is, of course, only a limited amount of space at any window area and, therefore, to arrange multiple plants in relatively direct exposure to sunlight at the window area ordinarily is a difficult task.

Typical plant stands and racks, as exemplified in U.S. Pat. Nos. Des. 241,216 and 224,746 rest on the floor and accordingly are too easily spilled, for example, during cleaning of the room in which they are located. Usually such racks are too low for full exposure of the plants thereon to direct sunlight at a window area unless a floor length window is available. Other types of shelving units that are suspendible usually require a solid wall for hanging or for stability purposes, but there would be no wall directly adjacent a window area. Also, such suspendible shelving units as well as the plant racks shown in the mentioned design patents all have solid shelves and/or supports that impede the free circulation of air about the plants thereon, and this plus possible limited sun exposure in the past may undesirably facilitate the growth of mold, mildew or the like.

SUMMARY OF THE INVENTION

In accordance with the present invention plural slats separated by spaces form one or more shelves in a plant rack to enhance the circulation of air therethrough. Moreover, such rack is conveniently suspendible, e.g. from the ceiling, to facilitate exposure to direct sunlight in a window area of the plants thereon, and preferably a plurality of such slatted shelves is commonly assembled and so suspended. A facile and stable suspension mechanism also is provided. In one embodiment balance of the respective slatted shelves is provided by tie-down bars mounted on also slatted vertical shelf supports and in another embodiment a cooperative notch arrangement is used for such purpose.

Accordingly, a primary object of the invention is to facilitate the placement, varying of arrangements, growth, maintenance, exposure to sunlight, inhibiting of mold and mildew, and the like of plants.

Another object is to enable the close packing of plants in a window area.

An additional object is to enhance the circulation of air in a close-packed collection of plants.

A further object is to impede the growth of mold, mildew, and the like in plant soil, containers, and the like.

Still another object is to reduce the spillage of plants and soil and damage to plants and their containers.

Still an additional object is to facilitate the suspending of plural plants.

Still a further object is to enhance the balance and stability of a suspending apparatus for plants and the like.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawing setting forth in detail certain illustrative embodiments of the invention, these being indicative, however, of but several of the various ways in which the principles of the invention may be employed.

DESCRIPTION OF THE PREFERRED EMBODIMENTS

Figure 1:
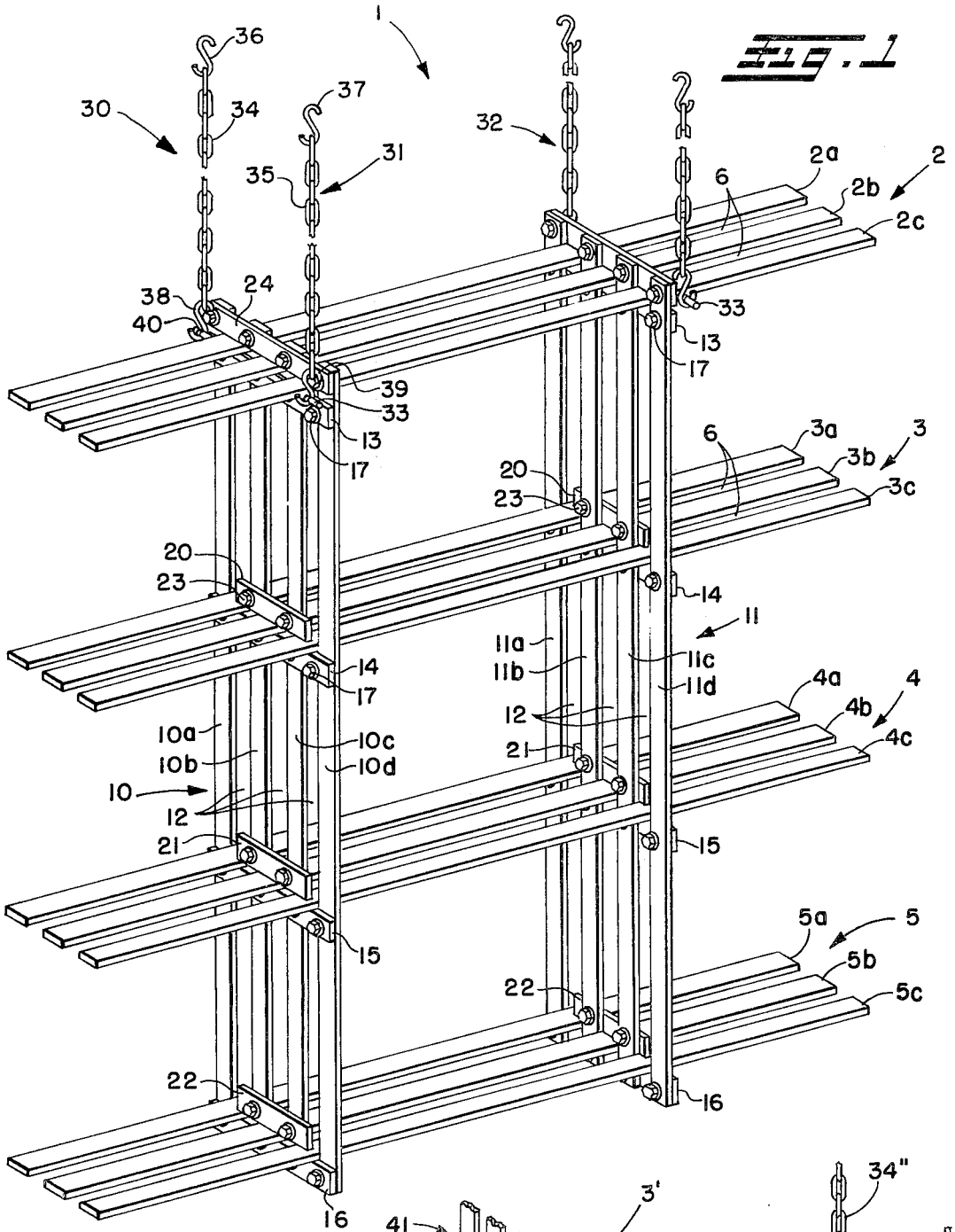
FIG. 1 is a front isometric view of a preferred embodiment of suspendible plant rack in accordance with the invention.

Referring now in detail to the drawing, and initially to FIG. 1, a suspendible plant rack in accordance with the invention is generally indicated at 1. The plant rack 1 is formed by at least one and preferably a plurality of shelves 2–5, each of which is slatted, being formed by a plurality of slats, such as those designated *2a, 2b, 2c; 3a, 3b, 3c;* etc., separated by substantially coextensive spaces 6. The slats may be formed of wood, plastic, or other material as desired, and the measurement parameters of each shelf 2–5 enable the supporting of plural plants in their respective containers thereon while the spaces 6 in each shelf importantly facilitate the free circulation of air about such plural plants and help to minimize shadows on the plants on lower shelves.

Vertical side supports 10, 11 hold the respective shelves 2–5 in horizontal planes, at vertically spaced-apart locations in the plant rack 1 while maintaining the lateral spacing of respective slats forming each shelf. Each vertical side support itself is formed by respective plural vertical slats, such as those designated *10a, 10b, 10c, 10d* with respective spaces 12 therebetween. The spaces 12 enable the placement of respective shelf slats therein and also importantly further facilitate the free circulation of air in the area of the plant rack 1. Such free circulation of air that is particularly enabled by the spaces 6, 12 helps to preclude the growth of mold, mildew, or the like on the plants or in their soil, etc.

Shelf supports 13–16 are secured to the vertical side support slats by fasteners 17, such as a typical bolt, washers, and nut combination, to hold such vertical slats in their relative parallel vertical orientation and respective shelf slats in the vertically and laterally separated manner illustrated. To hold the shelves 3, 4, 5 in stable, relatively balanced condition in the plant rack 1, tie-down bars 20, 21, 22, which are secured to the vertical side supports 10, 11 by fasteners 23, for example, prevent substantial vertical movement of the individual shelf slats. In a preferred embodiment the length of the tie-down bars is shorter than that of the shelf supports, again maximizing the air flow characteristics about the plant rack 1 and, additionally, conserving materials, although the tie-down bar length is sufficient to hold securely the respective shelf slats. A similar, but longer, tie-down bar 24 is used as a top support member for each of the vertical side supports 10, 11 for added strength of the overall plant rack 1 and to distribute the vertical hanging forces when the plant rack is suspended by its suspension mechanism 30. Thus, even as the plant rack 1 is suspended, the placement of only a single plant at one end of one of the shelves will not cause the opposite end to rise with a lever-like action; rather, the individual shelf remains balanced and preferably the weight of the plant rack itself is sufficiently larger than that of a single or a few plants so that the placement of such one or a few plants at one end of the rack still would not unbalance the same to an extent that would cause it to become unstable.

Figure 2:
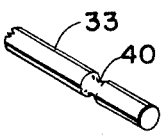
FIG. 2 is an enlarged partial isometric view of the hanger bar of the suspension mechanism for the plant rack of FIG. 1.

The suspension mechanism 30 includes a pair of hangers 31, 32 at opposite sides of the plant rack, for example, as shown, immediately adjacent the relatively opposite outside faces of the vertical side supports 10, 11. Each of the hangers 31, 32 is coupled to the mechanically assembled shelves 2–5 and vertical side supports 10, 11, for example, by a hanger bar 33, such as a dowel, which provides a balanced force distribution to the several slats forming the upper shelf 2. Moreover, each hanger includes one or more suspension lines, such as the illustrated chains 34, 35, which connect at one end by ceiling hanger hooks, such as S-hooks 36, 37 to conventional ceiling mounts fixed in the ceiling, not shown, and at the other end by similar hanger hooks 38, 39 to the hanger bar 33. If desired a lower chain link may be used as a hanger hook 38, 39 to receive the hanger bar ends therein. The suspension lines 34, 35 may be separated, as shown, or they may be coupled together forming two sides of a triangle completed by the hanger bar 33 with the apex of the triangle being coupled by a ceiling hanger hooks and/or by additional suspension line to the ceiling mount. Further to increase the stability of the plant rack 1 and particularly the suspension mechanism 30, the hanger bar 33 may have a detent, such as a partial or full circumferential groove 40, as is illustrated in FIG. 2, at opposite ends thereof to facilitate retention of the respective hanger bar hooks 38, 39 therein.

To assemble the plant rack 1, for example, the slats **10*a*–10*d* of each vertical side support 10, 11 are fastened together by respective shelf supports 13–16. All of the respective shelf slats, such as the slats 2*a*, 2*b*, 2*c* are positioned in the spaces 12 of the respective vertical side supports and secured therein by the respective tie-down bars 20, 21, 22, 24. The hanger bars 33 are placed beneath the top shelf 2**, and the respective suspending chains are coupled thereto and to respective ceiling mounts thus to suspend the plant rack from the ceiling, for example, directly in front of a window area.

The thusly assembly and suspended plant rack 1, then, can be conveniently used to support a plurality of plants thereon in direct exposure to sunlight at the window area while at the same time permitting good free air circulation fully about all of the plants. The spaces 6, 12, moreover, reduce shaddow area, thereby allowing a relatively maximum amount of sunlight to reach the plants, especially as compared to solid shelf racks.

Figure 3:
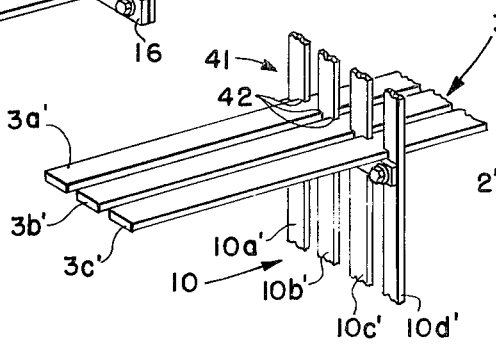
FIG. 3 is a partial isometric view of a cooperative notch arrangement for maintaining the shelf balance of an alternate embodiment of plant rack.

Each of the tie-down bars 20, 21, 22 and 24 and/or several of the shelf suports 13–16 of the plant rack 1 on both vertical side supports 10, 11, may be replaced by a cooperative notch arrangement 41, which is illustrated in FIG. 3. Such cooperative notch arrangement includes a plurality of notches 42 in the respective slats forming each of the vertical side supports, such as the one designated at 10' in FIG. 3, into which the respective slats, such as those designated **3*a*', 3*b*' 3*c*' forming the shelf 3' fit to effect the balancing or non-pivoting function achieved by the tie-down bars. Preferably the notches 42 would be formed only in one edge of the outermost side support slats, such as those shown at 10*a*', 10*d*', and in both edges of the interior side support slats, such as those at 10*b*', 10*c*'. If desired, while using the cooperative notch arrangement 41 embodiment of FIG. 3, the top support tie-down bar 24 of FIG. 1 still also may be utilized for added strength where the suspension mechanism 30** couples to the shelves and side supports.

Figure 4:
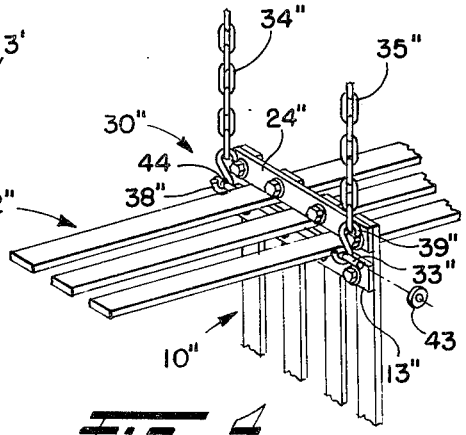
FIG. 4 is a partial isometric view, partly exploded, of an alternate hanger bar arrangement for the suspension mechanism of the plant rack.

An alternate embodiment of suspension mechanism 30'' is illustrated in FIG. 4, wherein double primed reference numerals designate parts corresponding to those illustrated in FIG. 1 and designated by unprimed reference numerals. The suspension mechanism 30'' includes a modified hanger bar 33'', which has a continuous surface profile, i.e. without the groove 40 of FIG. 2. The detent mechanism is provided, though, by retainer members 43, 44, such as rubber washers or rings, that may be slipped over the opposite ends of the hanger bar 33'' to be frictionally fixed thereon for holding the hanger bar hooks 38'', 39'' in place thereon. Thus, such modified hanger bar 33'' and retainers 43, 44 may be substituted for each of the grooved hanger bars 33 and the suspension mechanism 30 of FIG. 1.

In view of the foregoing, it will be appreciated that the plant rack 1 may be conveniently and securely suspended to support a plurality of plants, for example, in exposure to direct sunlight illumination in a window area while assuring relatively free air circulation about the plants, facilitating change in arrangements, and the like, as described in detail above.

The embodiments of the invention in which an exclusive property or privilege is claimed are defined as follows:

1. A suspendible plant rack, comprising at least three shelf means for supporting a plurality of plants therein, including at least top, intermediate and bottom shelves, each of said shelf means including a plurality of shelf slats separated by substantially coextensive spaces therebetween, whereby such spaces enable the relatively free circulation of air about the plant rack and the plants thereon, a plurality of side support means for holding the respective shelf slats of each shelf means in such spaced-apart position, each side support means including a further plurality of at least three side support slats separated by respective substantially coextensive side spaces therebetween such that a respective side support slat is in each coextensive space between adjacent shelf slats, shelf support means on each of said side support means and positioned beneath each shelf means for supporting each of said shelf means thereon, tie-down means cooperative with the lower respective shelf support means for holding respective shelf means in relatively vertically fixed positions on said side support means, each of said tie-down means being attached to at least two of said side support slats, being in engagement with all of the shelf slats of respective shelf means held thereby, and having a length less than the front to rear dimension of the plant rack, and hanger means for suspending said shelf means from above including bar means for distributing suspending forces over the width of said shelf means and suspension line means for holding said bar means and, thus, said shelf means in such suspension.

2. The rack of claim 1, further comprising notch means for holding respective shelf means in relatively vertically fixed positions on said side support means.

3. The rack of claim 1, wherein said hanger means further comprises hook means for coupling said suspension line means to said bar means.

4. The rack of claim 3, wherein said bar means includes detent means for retaining said hook means in relatively constant position thereon.

5. The rack of claim 4, wherein said detent means comprises recessed groove means in said bar means for retaining said hook means in relative position thereon.

6. The rack of claim 4, wherein said detent means comprises frictionally restrained retainers relatively proximate opposite ends of said bar means.

7. The rack of claim 1, wherein said suspension line means comprises chain.

8. The rack of claim 1, wherein said hanger means includes a pair of the same respectively positioned at oppositely disposed locations along said shelf means.

9. The rack of claim 8, wherein each of said pair of hanger means includes a pair of suspension line means, each being coupled to relatively opposite ends of a respective bar means.

10. The rack of claim 1, wherein said side support means, respectively, are located intermediate the ends of respective shelves to provide a useful, relatively sheltered area for a plant on a shelf between adjacent side support means and useful, relatively less sheltered areas for respective plants on the shelf more proximate the respective ends thereof.

* * * * *